US005535899A

United States Patent [19]

Carlson

[11] Patent Number: 5,535,899

[45] Date of Patent: Jul. 16, 1996

[54] REINFORCED NURSING NIPPLE

[76] Inventor: Dave M. Carlson, P.O. Box 802743, Santa Clarita, Calif. 91351

[21] Appl. No.: 419,823

[22] Filed: Apr. 11, 1995

[51] Int. Cl.[6] ..... A61J 11/00

[52] U.S. Cl. ..... 215/11.1; 277/235 R

[58] Field of Search ..... 215/11.1, 11.4, 215/11.5; 277/235 R, 235 A, 110, 164

[56] References Cited

U.S. PATENT DOCUMENTS

| | | | |
|---|---|---|---|
| 2,737,180 | 3/1956 | Perreault | 215/11.5 |
| 3,481,500 | 12/1969 | Palma | 215/11.5 |
| 4,428,593 | 1/1984 | Pearlstein | 277/235 A |
| 4,700,856 | 10/1987 | Campbell et al. | 215/11.1 X |
| 4,962,939 | 10/1990 | Lonne et al. | 277/235 R |
| 5,078,734 | 1/1992 | Noble | 215/11.1 X |
| 5,165,834 | 11/1992 | Takenouchi et al. | 277/235 R |
| 5,215,314 | 6/1993 | Nakaya | 277/235 R |

*Primary Examiner*—Allan N. Shoap
*Assistant Examiner*—Christopher J. McDonald
*Attorney, Agent, or Firm*—Roger A. Marrs

[57] ABSTRACT

An infant nursing bottle nipple is disclosed herein having an elongated feeding tip projecting from a bulbous base carried on an outwardly extending flange adapted to overlap the mouth of an infant nursing bottle. The flange includes an integrally formed reinforcement element such as a solid, rigid washer coaxially disposed with respect to the mouth of the bottle and which is of a diameter greater than the mouth so as to be placed on the bottle shoulder defining the mouth. A cap secured to the bottle bears against the reinforced flange preventing inadvertent withdrawal or displacement of the nipple during use.

2 Claims, 1 Drawing Sheet

REINFORCED NURSING NIPPLE

BACKGROUND OF THE INVENTION

1. Field of the Invention

The present invention relates to the field of nursing bottles, and more particularly to a novel nursing nipple having a reinforced flanged base incapable of deformation so as to be inadvertently pulled through the opening of a closure cap normally used to retain the nipple onto the threaded mouth of a nursing bottle.

2. Brief Description of the Prior Art

In the past, it has been the conventional practice to fabricate a nursing nipple having a feeding tip extending from a bulbous portion which is carried on a pliable and flexible outwardly extending flange. In practice, the flange is placed between the closure cap rigid rim and the shoulder of the mouth of the bottle. Difficulties and problems have been encountered with such a conventional nursing nipple which stems largely from the fact that oftentimes the closure cap is not properly engaged with the threads on the bottle so that the flexible and pliable flange may be pulled through the central opening of the cap upon tugging or pulling of the nipple by the infant. It oftentimes happens that the cap is not fully engaged with the bottle so that tugging forces may easily cause the pliable flange to slip from between the cap and the shoulder defining the mouth of the bottle which then permits the contents of the bottle to spill onto the infant or the surrounding area. Obviously, this is harmful to the infant and the infant does not gain benefit or nourishment from the bottle contents. In some instances, when the fluid within the bottle is warm or even hot, such fluids at elevated temperatures will harm the infant.

Attempts have been made to maintain the pliable flange in position, which take the form of providing ribs formed in the cap which bear against the pliable flange or in other instances, a solid washer is placed exteriorly of the nipple so as to provide some rigid and secure engagement when the cap is fully engaged with the threads on the bottle. Still, problems have existed here since the pliable or flexible flange can still be pulled through the opening in the cap when the cap has not been fully and securely engaged with the threadable connection on the bottle, see U.S. Pat. Nos. 3,113,569; 1,702,233.

Therefore, a long-standing need has existed to provide a means incorporated into the nursing nipple itself which will prevent inadvertent pulling or passage of the flange through the opening in the closure cap even in circumstances where the cap is not fully secured to the bottle.

SUMMARY OF THE INVENTION

Accordingly, the above problems and difficulties are avoided by the present invention which provides for integral reinforcement of the outwardly extending flange on the nursing nipple so that the flange is compressible in one direction but cannot be distorted or pulled through the opening in the cap when pulling or tugging forces are experienced. In one form of the invention, the reinforcement comprises a solid and rigid washer which is incorporated into the base flange so that the soft and resilient material of the nipple completly surrounds and encloses the washer. Therefore, forces applied on the top of the flange and the bottom of the flange may cause a slight distortion in order to properly seal between the closure cap and the shoulder defining the mouth of the bottle; however, the flange cannot be distorted or displaced in absence of the applied force whereby in conventional circumstances, the flange can be pulled through the opening in the closure cap.

Therefore, it is among the primary objects of the present invention to provide a novel nursing nipple having a reinforced outwardly extending flange supporting the feeding tip which can be compressed in an axial direction but cannot be bent or distorted so as to be pulled through an opening in the closure cap.

Another object of the present invention is to provide a means for positively retaining a nursing nipple in its operative position between a closure cap and the mouth of the bottle wherein the reinforcement means is integral with the outwardly extending base flange so that the flange cannot be distorted or rearranged from its seated position.

Yet another object of the present invention is to provide a means for protecting a nursing infant from inadvertent passage of the nipple through the opening in the closure element so as to release the fluid from the bottle.

A further object of the present invention is to provide a reinforcing means for a nursing nipple which prevents inadvertent removal or displacement of the nipple from its sealing position without using external parts and without requiring special closure caps or special construction on the mouth of the nursing bottle so that conventional closure caps and bottles may be used.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
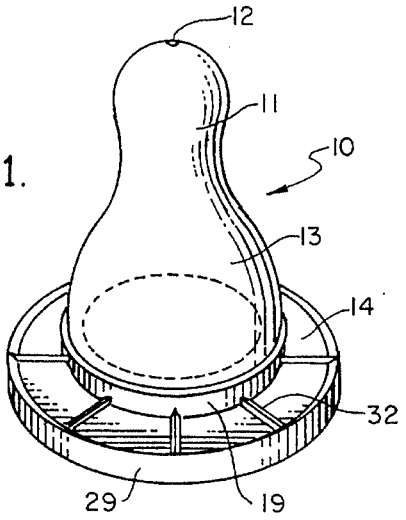
FIG. 1 is a front perspective view showing the novel nursing nipple of the present invention.
Figure 2:
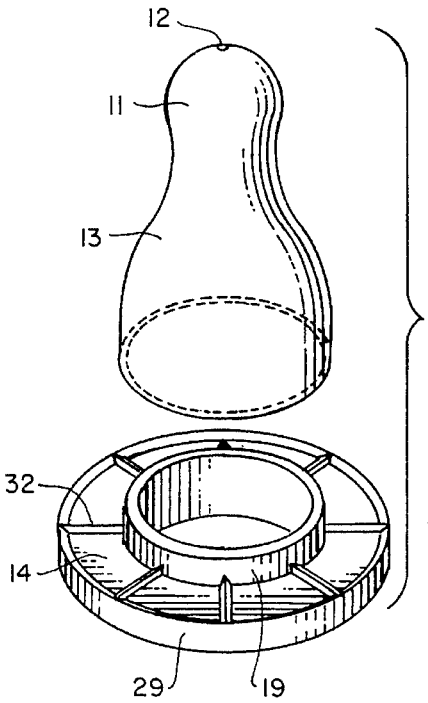
FIG. 2 is an exploded perspective view of the two component nipple construction of the nipple shown in FIG. 1.
Figure 4:
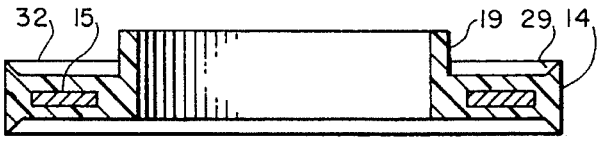
FIG. 4 is a transverse cross-sectional view of the flange base employed in the novel nursing nipple shown in FIG. 2.

Referring to FIGS. 1 and 2, the novel nursing nipple of the present invention is illustrated in the general direction of arrow 10, which includes a feeding tip 11 having a dispensing orifice 12 through which a fluid can flow during a nursing procedure. The feeding tip 11 is carried on a bulbous portion 13 suitable for holding a small quantity of the fluid preparatory to dispensing through the feeding tip 11. The bulbous portion 13 is secured to a collar 19 carried on an outwardly extending flange 14 by heat techniques, includes an upper surface and an under surface and a circular wall 29. The nursing nipple is formed so that a unitary construction is provided and the unitary construction includes a reinforcing means, such as a solid, rigid element 15, shown in FIG. 4, which is surrounded or enclosed by the material of the flange 14. The reinforcing means may take the form of an annular or circular washer, a resilient wavy washer 30 shown in FIGS. 6 and 7, or a segmented washer 31 shown in FIG. 5. The washer or ring may be composed of metal, rigid plastic or the like. The width of the element 15 is reduced from the width of the flange 14 so that both sides as well as the top and bottom of the element 15 are covered by the material of the flange 14.

With regard to the nursing nipple material, it is understood that the material is a soft pliable material that may be readily compressed or flexed with the exception of the reinforcing element 15 which is rigid. A plurality of ribs 32 radiate outwardly on the upper surface between collar 19 and wall 29. The element 15 is not exposed and is not intended to be handled separately by the user and when the material forming the nursing nipple includes a colored pigment, the element 15 is hidden from view and the nursing nipple provides an external appearance of such nursing nipples.

Figure 3:
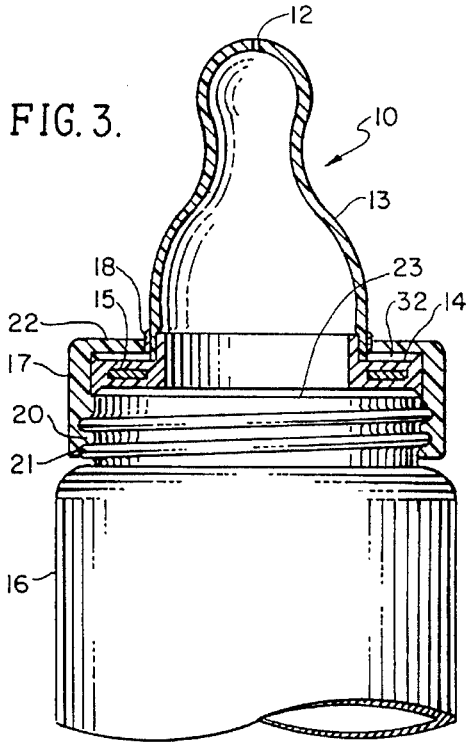
FIG. 3 is a longitudinal cross-sectional view of the nursing nipple shown in FIG. 1 and illustrated in its operative position with a closure cap and a nursing bottle.

Referring now in detail to FIG. 3, it can be seen that the nursing nipple 10 has been assembled with a conventional nursing bottle 16 by means of a closure cap 17. The closure cap includes a central opening 18 through which the bulbous portion 13 and the feeding tip 10 are passed, permitting the threaded sidewall 20 to engage with the external threads 21 formed at the mouth of the nursing bottle 16. The closure cap 17 includes a top member 22 having an under surface which bears against the top surface and ribs 32 of the flange 14 while the underside of the flange 14 bears against a shoulder 23 defining the entrance to the mouth of the bottle 16. Inasmuch as the flange is composed of a resilient material, a seal is provided when the closure cap is threadably engaged with the threads 21 of the nursing bottle. However, even if the cap is not fully tightened, removal of the nursing nipple by pulling or tugging through the opening 18 is prevented by the rigid reinforcing element 15. Inasmuch as this latter element is not pliable, the element cannot be distorted so as to pass through the opening 18 as is the conventional pliable flange on prior art nursing nipples.

It is again emphasized with respect to FIGS. 2 and 3 that the width of the reinforcing element 15 is narrower or of less dimension than the width of the flange 14 so that the reinforcement element is totally covered by the pliable and resilient material of the flange. It is also to be noted that the applied load force of the closure cap 17 is in an axial direction parallel to the longitudinal axis of the nursing bottle 16.

Such a load force is present whether the closure is fully tight, partially tight or semi-tight. Therefore, it is preferred that the upper surface of the reinforcing element 15 be ribbed so as to provide friction sealing against untightening of the cap. Thus, when semi or fully tightened, the material of the flange 14 will push laterally from the sides of the element 15 and inwardly towards the flat surfaces of the element 15 to form a complete seal against fluid leakage.

In view of the foregoing, it can be seen that the novel nursing nipple of the present invention provides a novel means of preventing inadvertent displacement or removal of the nipple from its installed position on a nursing bottle 16. The closure cap 17 maintains the reinforced flange 14 in position and even when the closure cap is not tightly installed on the nursing bottle, the nipple cannot be pulled or forced through the opening 18. The nursing nipple is of a unitary construction and does not require special machinery or special structural constructions such as reinforcing ribs, separate pieces which require assembly or the like.

Figure 6:
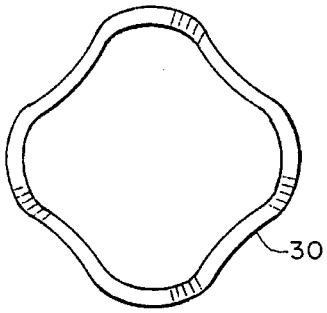
FIGS. 6 and 7 illustrate a wavy washer reinforcement ring.
Figure 5:
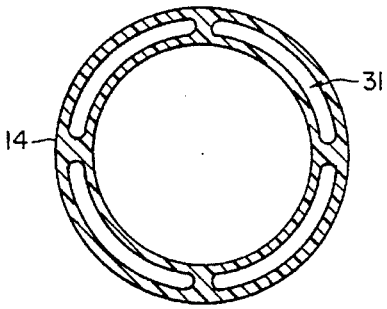
FIG. 5 is a sectional view of another version of the flange base utilizing a segmented reinforcement ring.
Figure 7:
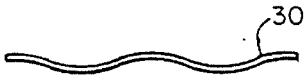

The reinforcement element, in FIG. 5, may take the form of segments 31 arranged in end-to-end relationship and since segments 31 are of semi-circular configuration in plan view, a circular washer is provided. In FIGS. 6 and 7 a resilient wavy washer 30 is shown that may be encapsulated by the flange base 14. The resiliency of the washer provides improved sealing characteristics. The ribs 32 and wall 29 engage with the underside of the cap 22 and offer resistence in the event the cap attempts to untighten. The collar 19 provides additional thickness and rigidity to the bulbous portion 13.

The upper edge of wall 29 bears against the cap while the lower edge bears against the threaded mouth 23 of the bottle 16 to provide additional sealing.

While particular embodiments of the present invention have been shown and described, it will be obvious to those skilled in the art that changes and modifications may be made without departing form this invention in its broader aspects and, therefore, the aim in the appended claims is to cover all such changes and modifications as fall within the true spirit and scope of this invention.

What is claimed is:

1. A nursing nipple and bottle combination comprising:

a unitary construction having a feeding tip carried on a bulbous portion with an outwardly extending reinforced flange base;

said reinforced flange base enclosing a rigid, non-flexible annular element;

said unitary construction composed of a pliable, resilient material covering and surrounding said rigid, non-flexible annular element whereby said feeding tip and said bulbous portion move and flex relative to said reinforced flange base;

said rigid, non-flexible annular element is a circular ring having a central opening defined by an inner edge surface and having an outer edge surface spaced from said inner edge surface, said annular element having a flat top surface and a flat bottom surface joining said inner edge surface and said outer edge surface;

said ring inner and outer edge surfaces and said ring flat top and flat bottom surfaces covered by said pliable, resilient material;

said ring top and bottom surfaces being parallel and having a width more narrow than the width of said flange base;

said pliable, resilient material includes a pigment obscuring said ring;

said ring is coaxially disposed with respect to said feeding tip and said bulbous portion and is enclosed solely by said flange base and is separate from said bulbous portion;

a nursing bottle having a circular shoulder defining an opening into the interior of said bottle;

a closure cap having a circular member defining a central opening for insertably receiving said bulbous portion and further having an undersurface engageable with said flange base so as to apply a sealing load thereto compressing said flange base between said closure cap circular member undersurface and said bottle shoulder;

said ring has a diameter greater than the diameter of said closure cap central opening; and said annular ring comprises a plurality of rigid semi-circular elements placed in end-to-end fixed spaced apart relationship.

2. A nursing nipple and bottle combination comprising:

a unitary construction having a feeding tip carried on a bulbous portion with an outwardly extending reinforced flange base;

said reinforced flange base enclosing a rigid, non-flexible annular element;

said unitary construction composed of a pliable, resilient material covering and surrounding said rigid, non-flexible annular element whereby said feeding tip and said bulbous portion move and flex relative to said reinforced flange base;

said rigid, non-flexible annular element is a circular ring having a central opening defined by an inner edge surface and having an outer edge surface spaced from said inner edge surface, said annular element having a flat top surface and a flat bottom surface joining said inner edge surface and said outer edge surface;

said ring inner and outer edge surfaces and said ring flat top and flat bottom surfaces covered by said pliable, resilient material;

said ring top and bottom surfaces being parallel and having a width more narrow than the width of said flange base;

said pliable, resilient material includes a pigment obscuring said ring;

said ring is coaxially disposed with respect to said feeding tip and said bulbous portion and is enclosed solely by said flange base and is separate from said bulbous portion;

a nursing bottle having a circular shoulder defining an opening into the interior of said bottle;

a closure cap having a circular member defining a central opening for insertably receiving said bulbous portion and further having an undersurface engageable with said flange base so as to apply a sealing load thereto compressing said flange base between said closure cap circular member undersurface and said bottle shoulder;

said ring has a diameter greater than the diameter of said closure cap central opening;

said bulbous portion is a separate component and said flange base is a separate component;

said flange base having a central opening defined by a circular collar;

said collar fixedly joined to said bulbous portion providing reinforcement;

said flange base having an upper surface defined between said collar and a circular wall carried on the edge of said flange base; and a plurality of spaced apart ribs radiating outwardly on said upper surface between said collar and said circular wall in fixed spaced apart relationship.

* * * * *